United States Patent [19]

Masters et al.

[11] Patent Number: 4,674,905

[45] Date of Patent: Jun. 23, 1987

[54] PRE-ASSEMBLED POST LOCK ASSEMBLY FOR LOOSE LEAF BINDERS

[75] Inventors: George S. Masters, P.O. Box #16, Round Pond, Me. 04564; George S. Masters, Jr., Bremen; Richard C. Masters, Bristol, both of Me.

[73] Assignee: George S. Masters, Sr., Round Pond, Me.

[21] Appl. No.: 427,192

[22] Filed: Sep. 29, 1982

[51] Int. Cl.[4] ..... B42F 13/00; B42F 13/12; B42F 13/34; B42F 13/22

[52] U.S. Cl. ..... 402/66; 402/54; 402/64; 402/69

[58] Field of Search ..... 402/54, 64, 66, 69; 267/166, 167, 174

[56] References Cited

U.S. PATENT DOCUMENTS

| | | | |
|---|---|---|---|
| 861,816 | 7/1907 | Dawson | 402/66 |
| 1,800,420 | 4/1931 | Webb | 402/64 |
| 2,895,484 | 7/1959 | Gramacy | 402/64 |
| 3,288,143 | 11/1966 | Federbush et al. | 402/64 |
| 4,201,492 | 5/1980 | Almgren | 402/54 |
| 4,411,544 | 10/1983 | Gallman | 402/69 |

FOREIGN PATENT DOCUMENTS

| | | | |
|---|---|---|---|
| 183565 | 7/1922 | United Kingdom | 402/64 |

*Primary Examiner*—Paul A. Bell
*Assistant Examiner*—Paul M. Heyrana, Sr.
*Attorney, Agent, or Firm*—Brooks Haidt Haffner & Delahunty

[57] ABSTRACT

A pre-assembled post lock assembly for loose leaf binders having separable covers which greatly simplifies mounting of the lock to the binder. A plastic sleeve press-fitted within the barrel assembly of the lock holds a spring biased ball carrier member in alignment with the barrel housing such that the locking balls are disposed for coaction with the cam surface of the barrel whether or not the lock assembly is mounted on the binder.

4 Claims, 5 Drawing Figures

PRE-ASSEMBLED POST LOCK ASSEMBLY FOR LOOSE LEAF BINDERS

BACKGROUND OF THE INVENTION

1. Field of the Invention

The present invention relates to post-type locks for loose leaf binders, and more particularly, it represents an improved locking assembly for such purpose.

2. Description of the Prior Art

Locks having outer barrels with tapered receiving ends, inner spring-loaded axially movable ball-carrying cylinders, and radially extending locking balls in cooperative relationship with those tapered ends are widely used to releasably secure together separable front and rear cover sections of loose leaf binders. Examples of such locks are shown in U.S. Pat. Nos. 3,288,143 to Federbush et al, and 4,201,492 to Almgren. The locks of these patents are intended to permit expansion or separation of the binder covers for holding together sizeable amounts of sheets of paper, especially when the binder contents are regularly updated with supplements or revisions. A separable type of loose leaf binder offers greater holding capacity than its multi-ring counterpart, and as compared to bound versions of the same text it easily permits the addition or substitution of revised sheets of material in lieu of replacement of an entire volume.

Nevertheless, until the present invention, there was a real need for a pre-assembled locking assembly which would facilitate installation of the lock to the binder. Locks of the barrel and bolt carrying cylinder type have heretofore required assembly by the binder manufacturer of a number of components, including several small locking ball elements thereof, in preparation for mounting the lock assembly to the carrying rib of the binder cover.

The foregoing drawback of those conventional post locking systems evidences the present need for a pre-assembled post lock assembly of the present invention which will facilitate the handling and installation of the lock by the binder manufacturer.

SUMMARY OF THE INVENTION

An improvement of post lock assemblies characterized by the present invention resides in providing a sleeve member formed of compressible material, having a memory, which on being press-fitted into an outer barrel of the lock assembly near the barrel's mounting end holds itself tightly in that position. The sleeve has a centrally located axial bore to slidably receive a ball carrier, and the sleeve is disposed in relation thereto so as to permit a resilient member, such as a compressed spring, to cooperatively engage and act between one of the sleeve's radial faces and a stepped area of the ball carrier. This spring outwardly urges the ball carrier towards a receiving end of the barrel.

In accordance with the present invention the sleeve also functions to guide the ball carrier for precise axial travel within the barrel. The sleeve's memory characteristics permit the sleeve to partially return to its non-deformed state, thus causing it to be wedged inside the barrel into tight frictional engagement with the interior wall surface thereof, yet with a small enough tolerance for the bore to permit accurate axial movement of the ball carrier, which will receive and securably retain a locking post member.

The improved lock of the present invention incorporates a new device which provides for an easier-to-handle post lock assembly, as compared to any of the aforementioned conventional locks. It enables the binder manufacturer to quickly install the lock without having to initially join together several small components in preparation for mounting the lock on the binder. Before the lock is shipped to the binder manufacturer the locking mechanism will have already been installed and it will be secured in operative position within the barrel by the sleeve device of the present invention. To mount the lock the binder manufacturer, or assembler, merely installs a mounting button through a properly sized opening in a rib of the binder cover into a press-fit relationship with the barrel reinforced at the mounting end thereof by a washer. To complete the assembly a pull ring is then installed on the pin projecting out from the adjacent end of the ball carrier.

The foregoing and other improvements, and advantages of the present invention will be more fully understood from the following detailed description of a preferred embodiment of the present invention, especially when that description is read in conjunction with reference to the accompanying drawing figures.

BRIEF DESCRIPTION OF THE DRAWINGS

In the drawings, in which like reference characters indicate like parts throughout.

DESCRIPTION OF THE PREFERRED EMBODIMENT

Figure 1:
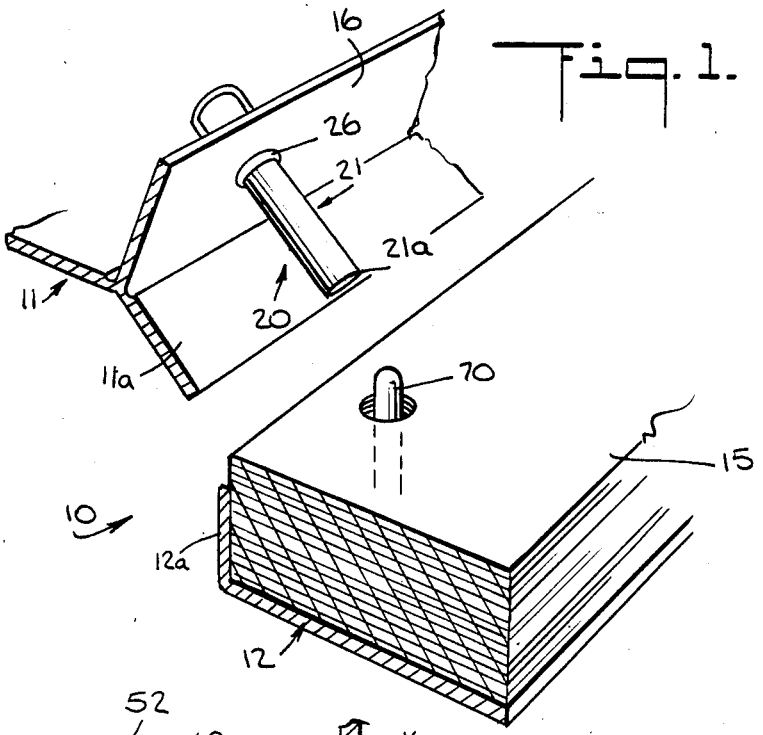
FIG. 1 is a partial view in perspective of a post-type loose leaf binder in its open condition and having a post lock which incorporates the present invention.

Referring to the drawings, FIG. 1 shows a typical loose leaf binder generally designated by reference numeral 10. As illustrated, the binder 10 has separable top and bottom cover members 11 and 12, respectively, which are adapted to hold together a plurality of sheets of paper 15 of textual material or the like. Overlapping end members 11*a* and 12*a* extend from the covers 11 and 12. The binder cover 11 also has a rigid flange portion 16 that carries an improved locking device according to the present invention, which lock device is generally designated by reference numeral 20.

Figure 3:
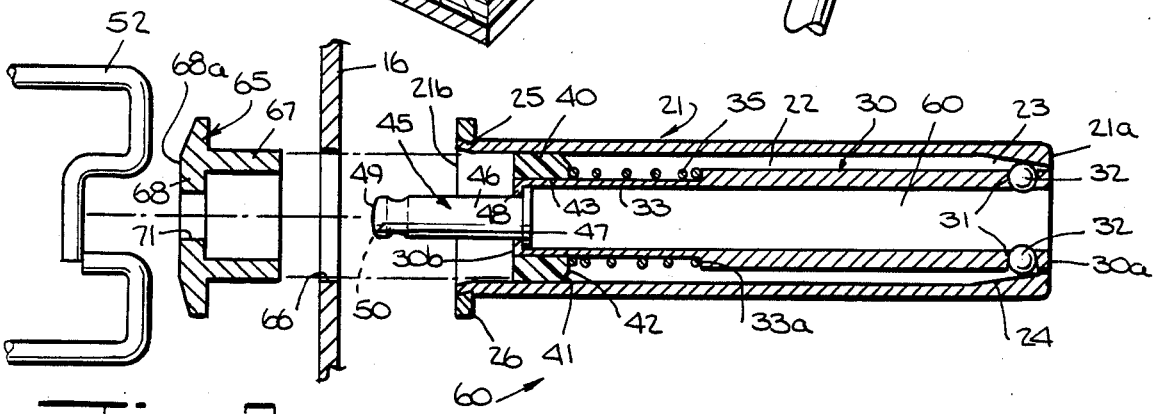
FIG. 3 is an enlarged sectional view in part of the post lock of FIG. 2 taken along line 3—3 of FIG. 2 and looking in the direction of the arrows.
Figure 4:
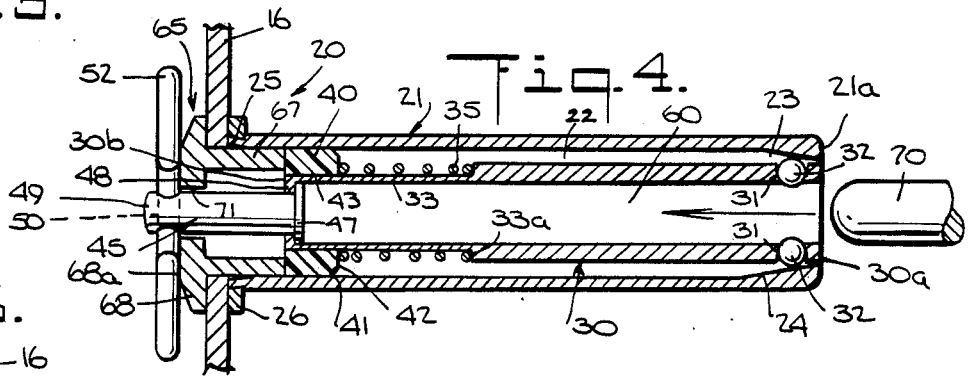
FIG. 4 is a view similar to FIG. 3, but showing the post lock in a fully assembled condition mounted on the binder and ready to receive a post member.

Referring now to FIGS. 3 and 4, the lock 20 is shown to have an elongated cylindrical barrel or housing member 21 which has an axial bore 22, one portion 23 of which is of a gradually reduced diameter which converges inwardly toward a receiving end 21*a* of the barrel 21 to provide an internal taper or cam surface 24. An opposite end 21*b* of the barrel 21 is adapted for mounting to the cover flange 16 and is shown preferably to have an annular recess at 25 over which there is pressedon a reinforcing member, such as a washer 26. Although not illustrated, the barrel 21 and the reinforcing member 26 could also be of unitary construction.

An elongated generally cylindrical ball carrier 30 of somewhat smaller diameter and shorter length than the barrel 21 is slidably disposed within the barrel bore 22, 23 for coaxial movement therein. A lockihg end 30*a* of the ball carrier 30 is formed with bores 31 to receive a plurality (normally three) of arcuately spaced radially extensible locking balls 32 (two of which are shown), and towards an opposite end 30*b* of the carrier there is a reduced portion 33 with a smaller outer diameter forming a shoulder at 33*a*.

A coiled spring 35, or any other suitable resilient member such as a rubber sleeve (not shown), encircles the reduced portion 33 of the ball carrier 30, and is loaded in compression between the shoulder 33*a* and a sleeve member 40.

The sleeve 40 is preferably formed of nylon, but any comparable compressible material having a memory would be acceptable, and it is sized having a slightly greater O.D. than the I.D. of the barrel 21 to insure tight frictional engagement therewith when installed therein. There is a chamfer 41 on the outer edge of an inner radial face 42 of the sleeve 40 to aid installation of the sleeve 40 into the barrel 21. The sleeve 40 has a centrally located axial bore 43 to slidably receive the extending portion 33 of the ball carrier 30 with a suitable tolerance fit so as to accurately guide the ball carrier 30 for smooth, controlled axial movement within the barrel 21.

The inner radial face 42 of the sleeve member 40 serves as a stop, like the shoulder 33*a*, against action of the spring 40.

A central rod-like pull pin 45, has a shank 46 slidably received in the open end 30*b* of the ball carrier 30. A stepped radially extending flange 47 at the inner end of the pin 45 is formed to engage for cooperation with an inwardly extending lip 48 around the open end 30*b* of the ball carrier 30. This enables the ball carrier 30 to be pulled up against the action of the spring 35 when the pin 45 is pulled up. On initial assembly this relationship of flange 47 and lip 48 acts to prevent the pin from falling out through the end 30*b*. The outer end 49 of the pin 45 has a transverse bore 50 therethrough for the reception of a pull ring 52.

Prior to insertion of the ball carrier 30 into the barrel 21 the pin 45 may be inserted into the interior space 60 of the carrier through the locking end 30*a* thereof, since the locking balls 32 can be retracted or moved outwardly in a radial direction to permit the flanged end 47 of the pin 45 to pass through. When the ball carrier 30 is inserted into the barrel 21, as illustrated, the locking balls 32 will be moved radially inwardly by the action of the surface 24, thus the pin 45 cannot fall out of the assembly. When desired, shank 46 of the pin 45 can be pushed through the open end 30*b* of the ball carrier 30 for application of the pull ring 52.

With the parts as hereinbefore described, in assembled relationship as shown in FIG. 3, a pre-assembled lock assembly 60 is thus formed for mounting to the rib 16 of a loose leaf binder.

To mount the lock assembly 60 to the binder rib 16 all that need be done is to insert a mounting button 65 through a properly sized opening 66 of the rib, and then press the cylindrical body 67 of the button 65 into the barrel end 21*b*, which is reinforced by the washer 26, until the rib 16 is securely clamped between a head 68 of the button 65 and the washer 26. Then a member, such as an extending locking post 70 mounted on the binder cover 12, can be inserted into the ball carrier 30 at the locking end 30*a* thereof to push the pull pin 45 out at the far end of the barrel 21 through a suitably sized opening 71 52 can then be seated in the bore 50.

Figure 2:
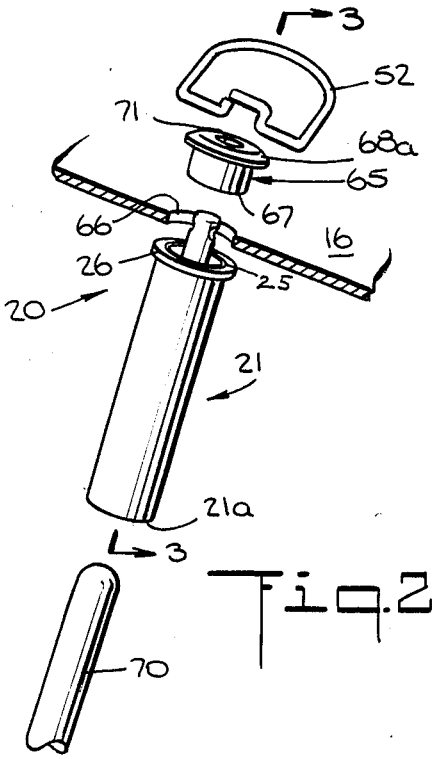
FIG. 2 is an exploded view in perspective showing a post lock according to the present invention ready to be assembled to the flange of the binder cover.
Figure 5:
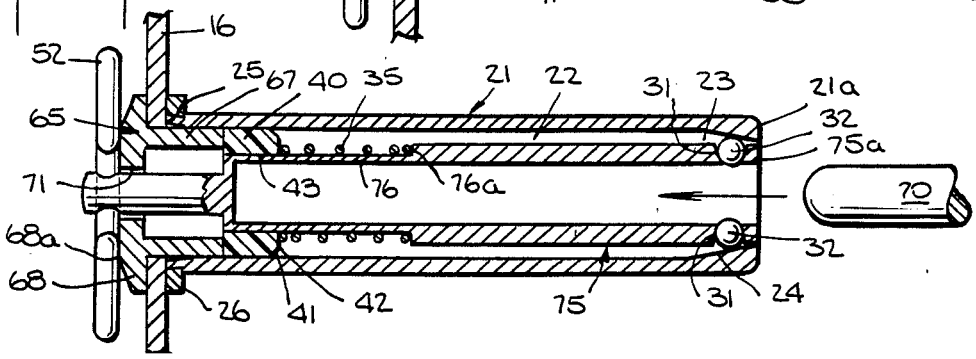
FIG. 5 is a view similar to FIG. 4, but showing a modified form of the ball carrier.

FIG. 5 shows a modified form of a pre-assembled post lock assembly in accordance with the present invention with like components as hereinbefore described. However, this design incorporates a modified ball carrier 75 slidably disposed within the barrel bore 22, 23, like the ball carrier 30, for coaxial movement therein. A locking end 75*a* of the ball carrier 75 is similarly formed with bores 31 to receive arcuately spaced locking balls 32, and there is also a reduced portion 76, forming a shoulder at 76*a* against which abuts the spring 35. A sleeve 40, as in FIGS. 1–3 seats tightly in the barrel 21 and guides the portion 33 as previously described. The ball carrier 75 differs substantially from the ball carrier 30 in that the pin 45, which coacts with the latter of the two ball carriers, is now incorporated into the ball carrier 75 as an integral extension 75 *a* thereof.

Materials of construction can be metal, such as steel, brass, zinc, or copper, or they can be plastics, except that the locking balls 32 are preferably formed of steel. However, with plastic barrels it is preferable that a metal insert be molded in at the taper 24 to provide a hard surface for the locking balls 32 to ride on. A plastic surface may wear or deform easily. Of course, as hereinbefore indicated, the sleeve member 40 is preferably made of nylon.

The tapered surface 24 forces the locking balls 32 into frictional engagement with the locking post 70 to effect a locking action against movement of the post 70 in an outward axial direction. In order to release the lock 20 from locking engagement with the locking post 70 to permit separation of the binder covers 11, 12 for access to the loose leaf sheets 15, the pull ring 52 is grasped and pulled upwardly, or, as viewed in the drawing, from right to left. As the pull ring 52 is raised out of its plane parallel to the binder rib 16 to a position that is generally perpendicular to the plane of the binder rib 16, the coaction of the pull ring 52 with an outer surface 68*a* of the head 68 of mounting button 65 causes the pin 45 and the ball carrier 30, or the ball carrier 75 (see FIG. 5), to move against the action of the spring 40. Thus the locking balls 32 can move outwardly releasing their grip on the locking post 70 as the locking balls 32 move inwardly within the barrel 21 along the taper 24. Top binder cover 11 may then be lifted away from the bottom cover 12.

While a preferred embodiment of the invention has been shown and described, various modifications, changes in size and shape of parts, etc., will suggest themselves to those familiar with the art, and such changes are considered to be within the spirit and scope of the invention.

What is claimed is:

1. A pre-assembled post lock ready for application per se to a loose leaf binder having a pair of separable covers comprising:

an elongated tubular housing member adapted for mounting at one axial end to a first one of the binder covers, the interior of said housing member adjacent said one axial end having an interior surface for receiving the cylindrical body of a mounting button for securing said housing member to a loose leaf binder cover, said housing member having an internal tapered surface at its other axial end converging inwardly in a direction away from the mounting end;

an elongated innner ball carrier member, in the form of a cylinder hollow throughout, of shorter length that that of said housing member coaxially disposed within said housing member and biased therein for limited axial movement, the ball carrier member carrying at one axial end a plurality of arcuately spaced locking balls disposed to cooperatively engage the tapered surface of the housing member;

a pin mounted for axial movement with respect to the other end of said ball carrier member and extendable for slidable action through said mounting button, the outer end of said pin being formed to receive an actuating ring in a manner for said ring to lie flat against the outer surface of said mounting button;

a sleeve tightly secured in said housing member at a position spaced below said receiving surface, said sleeve interior receiving a portion of said ball carrier member and maintaining said ball carrier member in slidable axial alignment with said housing member such that the locking balls are disposed for coaction with the tapered surface of the housing member;

a shoulder on said ball carrier member opposed to and spaced from the inner end of said sleeve; and resilient means maintained in compression between said sleeve end and said shoulder for urging the ball carrier member towards the housing member end which has the internal tapered surface, said sleeve securing the elements of said post lock in assembled condition and maintaining the correct distance between said sleeve and said shoulder.

2. The post lock assembly of claim 1 wherein said pin has a portion mounted for slidable action within the hollow of said ball carrier and a portion extending beyong said other end of said ball carrier, said locking balls retaining said pin within the hollow of said ball carrier on assembly of said post lock.

3. The post lock assembly of claim 2, wherein said sleeve is formed of resilient plastic material with a memory formed to resiliently maintain a set position within said housing regardless of any distortions of said housing caused by the pressing in place of the cylindrical body of said mounting button and said sleeve has an internal bore formed to provide smooth slidable movement for said ball carrier.

4. A post lock for a loose leaf binder having a pair of separable covers comprising:

an elongated locking post member connected to a first one of the binder covers;

a pre-assembled lock assembly for receiving said locking post including, and elongated cylindrical housing member, means connecting said housing member at one axial end to the second binder cover, said connecting means having a cylindrical portion secured in a press fit within said one axial end, the housing member having an internal tapered surface at its other axial end and converging inwardly in a direction away from the connected end;

an elongated innter ball carrier member of shorter length than that of said housing member coaxially disposed within the housing member and biased therein for limited axial movement to receive for coaction the locking post member, the ball carrier member carrying at one axial end a plurality of arcuately spaced locking balls disposed for cooperative engagement between the internal tapered surface of the housing member and the surface of the locking post member; and resilient means maintained in compression for urging the ball carrier member towards the housing member end which has the internal tapered surface; wherein the improvement comprises:

a sleeve formed of resilient plastic material with a memory located between said housing member and said ball carrier member and maintaining a tight gripping relationship with respect to said housing member regardless of distortion of said housing member caused by the pressing of said cylindrical portion of said connecting means into said one axial end forming a slidable bearing for said ball carrier member and positioned inwardly of said cylindrical portion of the connecting means for holding the ball carrier member in coaxial alignment with the housing member, said ball carrier member formed with a shoulder in opposition to the inner end of said sleeve, said urging means acting between said shoulder and said sleeve, said sleeve securing the elements of said post lock in assembled condition so that said post lock assembly can be secured per se to said second binder cover; and a pin mounted on said ball carrier member for axial movement with respect thereto and extendable outwardly through said connecting means, a ring to actuate said pin and ball carrier mounted on said extending portion of said pin in a manner to enable said ring to lie flat against said connecting means so that the covers of said binder can fold into closed position.

* * * * *

UNITED STATES PATENT AND TRADEMARK OFFICE

CERTIFICATE OF CORRECTION

PATENT NO. : 4,674,905

DATED : June 23, 1987

INVENTOR(S) : George S. Masters et al

It is certified that error appears in the above-identified patent and that said Letters Patent is hereby corrected as shown below:

Column 3, line 4: "A lockihg" should read --A locking--.

Column 4, line 3: entire line is omitted: after "71" and before "52", insert the following:

--in the head 68 of the mounting button 65 so that the pull ring--.

Column 5, line 3: "that that of" should read: --than that of--.

Column 6, line 2: "and elongated" should read: --an elongated--.

Signed and Sealed this

Thirteenth Day of October, 1987

*Attest:*

DONALD J. QUIGG

*Attesting Officer*

*Commissioner of Patents and Trademarks*